US007289871B2

(12) United States Patent
Williams

(10) Patent No.: US 7,289,871 B2
(45) Date of Patent: Oct. 30, 2007

(54) DRILLING APPARATUS

(75) Inventor: Timothy Garry Williams, Central Otago (NZ)

(73) Assignee: Atlas Copco Rock Drills AB, Orebro (SE)

( * ) Notice: Subject to any disclaimer, the term of this patent is extended or adjusted under 35 U.S.C. 154(b) by 44 days.

(21) Appl. No.: 10/548,140

(22) PCT Filed: Mar. 10, 2004

(86) PCT No.: PCT/NZ2004/000051

§ 371 (c)(1),
(2), (4) Date: Sep. 6, 2005

(87) PCT Pub. No.: WO2004/081332

PCT Pub. Date: Sep. 23, 2004

(65) Prior Publication Data

US 2006/0161289 A1 Jul. 20, 2006

(30) Foreign Application Priority Data

Mar. 10, 2003 (NZ) ..... 524666

(51) Int. Cl.

| | |
|---|---|
| ***G06F 19/00*** | (2006.01) |
| ***E21B 47/00*** | (2006.01) |
| *E21B 47/02* | (2006.01) |
| *E21B 19/00* | (2006.01) |

(52) U.S. Cl. ..... 700/160; 700/177; 175/40

(58) Field of Classification Search ..... 700/186, 700/160, 177; 173/53, 218; 175/40
See application file for complete search history.

(56) References Cited

U.S. PATENT DOCUMENTS

| | | | | |
|---|---|---|---|---|
| 842,227 | A * | 1/1907 | Morse | 408/236 |
| 3,674,098 | A * | 7/1972 | Virgo | 173/149 |
| 4,230,189 | A | 10/1980 | Mashimo et al. | |
| 4,296,820 | A | 10/1981 | Loftis | |
| 4,448,263 | A * | 5/1984 | Becker et al. | 173/34 |
| 4,601,000 | A * | 7/1986 | Montabert | 173/11 |
| 4,740,037 | A * | 4/1988 | Eager et al. | 299/45 |
| 4,761,876 | A * | 8/1988 | Kosmowski | 483/1 |

(Continued)

FOREIGN PATENT DOCUMENTS

| | | |
|---|---|---|
| EP | 0223575 | 5/1987 |

(Continued)

*Primary Examiner*—Michael D. Masinick
(74) *Attorney, Agent, or Firm*—Mark P. Stone

(57) ABSTRACT

The invention provides a drilling apparatus (1) having a base (2) from which a drilling arm is pivotally mounted. The drilling arm (3) has an inner arm (4) and an outer arm (5). The inner arm (4) has a first end (6) and a second end (7). The first end (6) is pivotally connected via a first pivot joint (8) to the base (2). The outer arm (5) has a first end (9) and a second end (10). The second end (7) of the inner arm (4) is pivotally connected via a second pivot joint (11) to the first end (9) of the outer arm (5). At the second end (10) of the outer arm (5) is a drill mounting assembly (12). Actuation of the inner and outer arms (4) and (5) is achieved via drive means in the form of hydraulic cylinders (13). Proper operation of the cylinders (13) causes the second end (10) of the outer arm (5) to follow a substantially linear path.

23 Claims, 7 Drawing Sheets

U.S. PATENT DOCUMENTS

| | | | | |
|---|---|---|---|---|
| 4,890,680 | A | 1/1990 | Porsfeld et al. | |
| 5,340,199 | A * | 8/1994 | Piefenbrink et al. | 299/10 |
| 5,709,276 | A * | 1/1998 | Lee | 175/122 |
| 5,787,758 | A * | 8/1998 | Sheldon | 74/490.07 |
| 6,332,502 | B1 | 12/2001 | Mills et al. | |
| 6,857,483 | B1 * | 2/2005 | Dirks et al. | 175/52 |
| 7,128,633 | B2 * | 10/2006 | Wilson | 446/425 |
| 2002/0005297 | A1 * | 1/2002 | Alft et al. | 175/26 |

FOREIGN PATENT DOCUMENTS

| | | |
|---|---|---|
| EP | 0805257 | 11/1997 |
| EP | 0825330 | 2/1998 |
| FR | 2351217 | 12/1977 |

* cited by examiner

DRILLING APPARATUS

FIELD OF THE INVENTION

This invention relates to improvements in or relating to drilling apparatus. More specifically, but not exclusively, the invention relates to improvements in such apparatus used in demanding environments such as the mining, tunneling and water bore drilling industries.

BACKGROUND

An area of significant application of drilling apparatus in both the mining and tunneling industries is in drilling holes for rock-bolting. Rock-bolting is undertaken to prevent rock falls and cave-ins, and to otherwise stabilise the tunnel or mine roof and walls.

In the mining or quarrying industries drilling apparatus are also used as part of the excavation process, for example, with holes being drilled to set explosives for blasting. Other uses include drilling small diameter holes for purposes such as stoping, and probe drilling.

Prior art drilling apparatus for use in the aforementioned situations normally includes a boom along which a percussion hammer drill slides. The boom is typically mounted longitudinally in a cradle with the drill slidably mounted on the boom. A separate feeding mechanism is provided for displacing each of the boom and the drill. In such apparatus the drill is typically moved by means of a chain or rope which goes around wheels mounted at the ends of the boom and the ends of which are fastened to the drill. The chain is moved by actuation of a hydraulic cylinder or the like. The boom, in turn, is moved with respect to the cradle by means of a hydraulic cylinder mounted between it and the cradle.

A factor relevant to the design of drilling equipment used in underground mining and tunneling is the issue of size and manoeuvrability in a confined space.

In prior art apparatus, if a 6 m hole is required to be drilled, the boom must also be 6 m long. Such a configuration is able to drill shorter holes, however, when a shorter hole is required a 6 m boom with a 2 m drill steel has 4 m of wasted boom behind the drill.

Drilling rigs attached to wheeled vehicles are often required to manoeuvre around very tight corners in underground tunnels. The length of the drilling apparatus often hinders its manoeuvrability, and collisions are frequent. Disassembly, in order to improve manoeuvrability is generally impractical.

In addition to space considerations, the drilling apparatus used in mining, tunneling and quarrying must be of robust and rugged design to cope with other aspects of the harsh environment.

Unfortunately the sliding arrangements of prior art drilling apparatus do not fully address this requirement, and have high maintenance needs. Usually the greatest damage occurs to exposed hydraulic hosing supplying the driving force to the hydraulic cylinders generating forward movement of the boom, and to the drill. Another problem area is the exposed hydraulic hose reeler. These are at constant risk of damage due to falling rocks or from being crushed by any number of the moving parts.

In addition to rock fall damage, excessive wear and tear is generated by the extreme working environment. The sliding system used to advance the drill steel into the rock is poorly suited to a situation where fine rock chips from flushing water are constantly washed over and between the wearing surfaces. Where a percussion drill is employed, this situation is compounded by the hammer action which generates significant component vibration causing acceleration of wear between moving parts. These prior art systems also have various other significant wearing parts involved in the act of moving the drill forward which are subjected to similar wear patterns.

The sliding configuration of the prior art apparatus also hinders other activities commonly engaged in as part of the tunneling or mining process, such as, for example, the application of shot-crete. Shot-crete is an extremely abrasive material, containing steel fibres suspended in concrete. This is sprayed onto the tunnel interior for roof stabilisation purposes. If shot-crete is accidentally sprayed onto the sliding surfaces of the prior art apparatus wear is accelerated, and repair costs are increased.

Another recognised area of application of the invention, primarily because of the compact nature of apparatus constructed according to the invention, is use in conjunction with bore drilling rigs which can need to be transported from one site to another on public roads and highways.

Existing configurations typically employ a tower design to drill substantially vertically downwards. Such arrangements are cumbersome and can often require considerable set up time after transport to the drill site. Further, because of the general configuration of such equipment, transportation in itself is an issue. Even partially disassembled, the movement of such equipment on public roads means heavy transport vehicles are required, the transport operation is time consuming and costly. Public inconvenience also often becomes an issue.

It is an object of the invention to provide drilling apparatus which overcomes at least some of the above identified problems with prior art apparatus, or which at least provides the public with a useful choice.

SUMMARY OF THE INVENTION

In its broadest aspect the invention provides a drilling apparatus having a base to which a drill mounting arm is pivotally connected, said drill mounting arm comprising an inner arm and an outer arm, said inner arm having a first end and a second end and said outer arm having a pivot joint end and a free end, said first end of the inner arm being pivotally connected via a first pivot joint to the base and said second end being pivotally connected via a second pivot joint to the pivot joint end of the outer arm, a mounting means adapted to in use mount a drill being provided at the free end of the outer arm, the apparatus further including drive means adapted to drive the mounting means at the free end of the outer arm along a substantially linear path.

Preferably the inner arm is offset from the outer arm to allow the outer arm to rotate past the inner arm without interference. Optimally the outer arm can rotate at least 320 degrees relative to the inner arm.

Preferably the inner arm can rotate 180 degrees relative to the base.

Desirably the inner arm and the outer arm are substantially the same length, and the base is configured and arranged to avoid interfering with the free end of the outer arm.

Conveniently the mounting means is pivotally mounted via a third pivot joint to the free end of the outer arm.

Preferably the drive means comprises one or more hydraulic cylinders. Optimally the one or more hydraulic cylinders drive pivoting of the first, second and third pivot joints.

Desirably the second pivot joint includes an offset arm on the same axis as the outer arm but offset by 90 degrees to the outer arm, actuation of the second pivot joint being achieved via a pair of said hydraulic cylinders mounted such that when the first said hydraulic cylinder is fully extended or retracted, and therefore has no ability to rotate the outer arm, the second said hydraulic cylinder is in the middle of its stroke.

In a more preferred form the invention the third pivot joint serves as a drill angle correction joint so as to, in use, keep a drill steel on the correct plane during the drilling process.

Preferably the apparatus further includes a drill steel support arm to, in use, support the drill steel in the correct position during drilling.

Desirably the said support arm is retractable, with retraction or advancement of the support arm being parallel to the drilling axis.

Conveniently all hydraulic hosing associated with the drive means is housed within the inner and outer arms. Optimally in order to enable hydraulic fluid, water and air to reach the various hydraulic equipment and a drill in use mounted on the mounting means rotary seals and ported pins are employed in the joints and are configured and arranged to allow 360 degree rotation without twisting hoses.

Desirably the mounting means includes a shot-crete nozzle and the apparatus includes shot-crete feed pipes to enable, in use, shot-crete to be sprayed using the drilling apparatus.

Optimally the apparatus further includes computerised controls such that the various hydraulic control and positioning cylinders are actuated according to a pattern controlled by computer software.

Desirably the computerised controls include sensors to establish the positions of the various component parts of the apparatus and such computerised controls include self-diagnostic features so that when the inner and outer arms are in a certain physical position the sensors are checked for accuracy.

Conveniently a sensor is provided on the hydraulic fluid feed circuit to sense if the drill steel is starting to become jammed.

Preferably the apparatus includes a sensor on the hydraulic fluid feed circuit supplying rotation to the drill steel, said sensor being adapted to sense the frequency of the hammer action for determining the optimum feed speed/pressure settings.

Desirably the invention further includes electronic data storage and display means for data recorded from various sensors on the hydraulic and pneumatic feeds to establish tool and drill steel consumption and efficiency, rock hardness and geology and the number of bolts installed in a given period of use.

Advantages of the present invention are that it provides a feed device for rock drilling in which the structure carrying out the displacing movements is as simple as possible and utilises no sliding mechanism or exposed hoses.

A further advantage is that the apparatus according to the invention is able to multitask, being able to be used in such applications as spraying shot-crete, as well as a rock-bolt and probe drill.

A yet further advantage is that apparatus according to the invention can utilise a range of different drill steel lengths in the same configuration without wasting space.

A still further advantage is that the inventive apparatus can be easily folded into a compact form for transport purposes.

BRIEF DESCRIPTION OF THE DRAWINGS

Two preferred forms of the invention will now be described, by way of example only, and without limitation as to the intended scope of the invention as claimed. The preferred embodiments have particular application in rock drilling, and are described below with reference to the accompanying drawings. The drawings comprise FIGS. 1 to 19 as follows:

DESCRIPTION OF THE PREFERRED EMBODIMENTS

Figure 1:
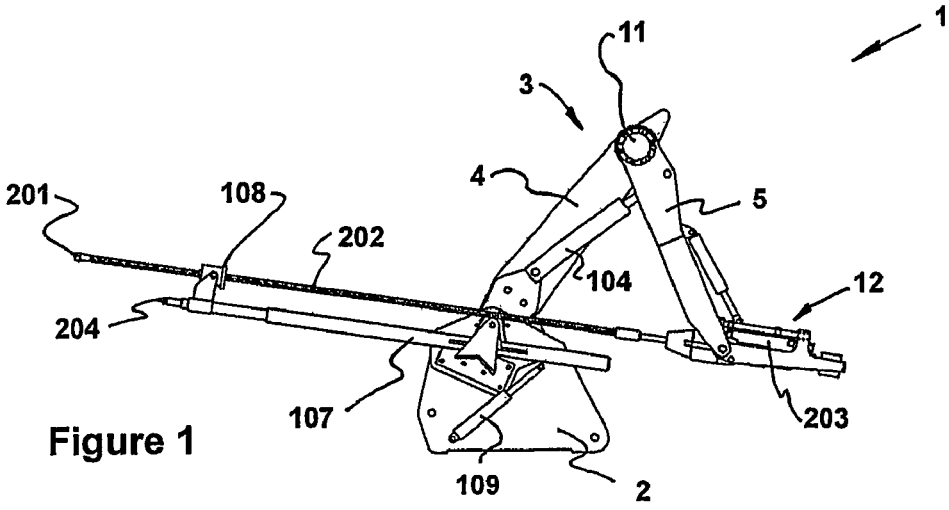
FIG. 1: is a side elevation of a drilling apparatus according to the present invention.
Figure 2:
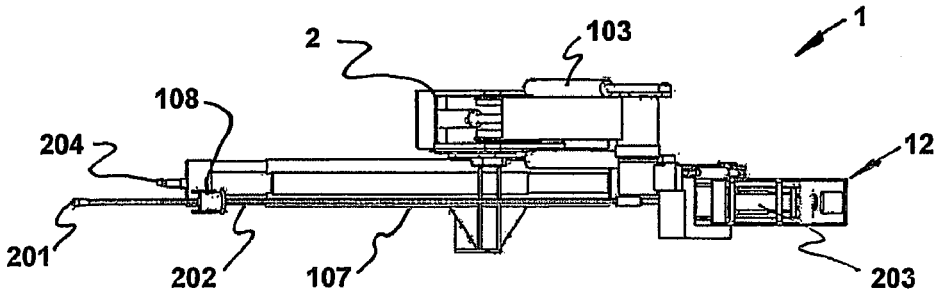
FIG. 2: is a plan view of the apparatus of FIG. 1.
Figure 3:
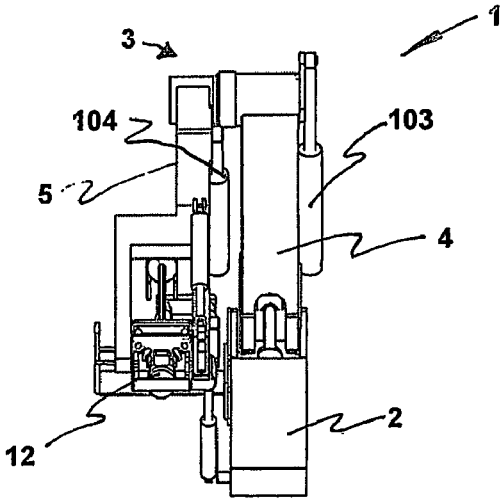
FIG. 3: is an rear view of the apparatus of FIG. 1.
Figure 4:
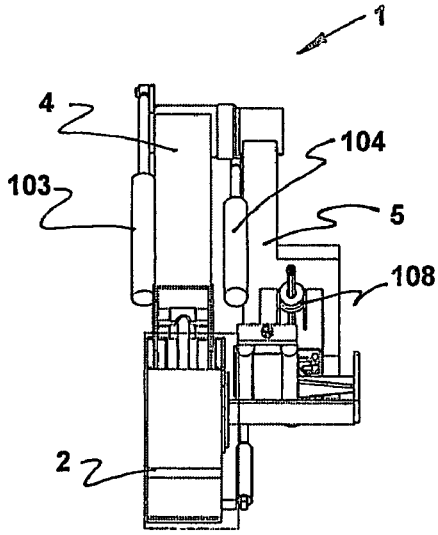
FIG. 4: is a front view of the apparatus of FIG. 1.

Referring to the drawings, a drilling apparatus as generally indicated at 1 is provided. The apparatus 1 has a base 2 from which a drilling arm 3 is pivotally mounted. The drilling arm 3 has an inner arm 4 and an outer arm 5.

The inner arm 4 has a first end 6 and a second end 7. The first end 6 is pivotally connected via a first pivot joint 8 to the base 2. The outer arm 5 has a first end 9 and a second end 10. The second end 7 of the inner arm 4 is pivotally connected via a second pivot joint 11 to the first end 9 of the outer arm 5.

At the second end 10 of the outer arm 5 is a drill mounting assembly 12.

Actuation of the inner and outer arms 4 and 5 is achieved via drive means in the form of hydraulic cylinders 13. Proper operation of the cylinders 13 causes the second end 10 of the outer arm 5 to follow a substantially linear path.

The inner arm 4 is offset from the outer arm 5 to allow the outer arm 5 to rotate past the inner arm 4 without interference. The offset is such that the outer arm 5 can rotate at least 320 degrees relative to the inner arm 4.

The function of the first pivot joint 8 is to maintain the drill arm 3 at the correct angle during the drilling process. In the preferred embodiment illustrated in FIGS. 1 to 5 and 9 to 22 (hereafter "the first preferred embodiment") this is achieved using two hydraulic cylinders 101 and 102 for positioning. These cylinders 101 and 102 are offset by 75 degrees to each other. The reason for this is to have at least one of the cylinders 101/102 normal to the base joint 8 pivot axis at any given time and thus enable the inner arm 4 to rotate up to 180 degrees relative to the base 2.

In the first preferred embodiment hydraulic cylinders 103 and 104 manipulate the arms 4 and 5 relative to one another. The pivot joint 11 utilises an arrangement that enables the outer arm 5 to rotate more than 180 degrees.

In that regard, an offset lever 105, on the same axis as the outer arm 5, but having the hydraulic cylinder 103 driving position offset by 90 degrees to the cylinder 104 driving position of the outer arm 5 is provided. This means that when one cylinder 103/104 is fully extended or retracted, and therefore has no ability to rotate the arm, the other cylinder 104/103 is in the middle of its stroke. Thus when the offset arm cylinder 103 is fully retracted and cannot rotate the offset lever 105 the outer arm cylinder 104 is in the middle of its stroke and normal to the axis.

The inner arm 4 and the outer arm 5 are substantially the same length, and the arrangement of joints 8, 11 and arms 4, 5 is such that the drilling process is able to start from behind the base joint 8, and also means the arm 4, 5 lengths only need to be in the order of 28% of the drill steel length. For example, when using a 4 m drill steel each of the inner and outer arms 4, 5 need only be approximately 1.2 m long. This attribute therefore provides maximum flexibility as the range of drill steel lengths that can be used.

Mounted at the free end 10 of the outer arm 5 is a drill angle correction joint 14. The function of this joint 14 is to keep the drill on the correct plane during the drilling process. The mechanism used is known, being a mechanical assembly similar to that used to move hydraulic excavator buckets. This system includes a drill cradle 15 and a drill cradle positioning cylinder 106 move the drill cradle 15 up to 180 degrees.

The first preferred embodiment of the invention further includes a drill steel positioning arm 107. Attached to the forward end of this arm 107 is the drill steel guide block 108. The arm 107 has three functions, namely, it targets the head 201 of the drill steel 202, it holds the drill steel 202 in position for collaring the hole, and it moves to the middle of the drill steel 202 as a support when the drill 203 is working.

The arm 107 is retractable, with the direction retraction or advancement being linear and parallel to the drilling axis. The arm 107 is pivotally mounted to the base 2, with rotation being actuated by a hydraulic cylinder 109 extending between the arm 107 and the base 2.

Stability for the drill steel 202 when collaring is not given by the rigidity of the arm 107 but rather, by the point 204 at the free end of the arm 107 pushing into the rock. This force is achieved by applying an extending force to the arm 107, preferably resulting in an applied force of up to 8 tonnes.

Figure 5:
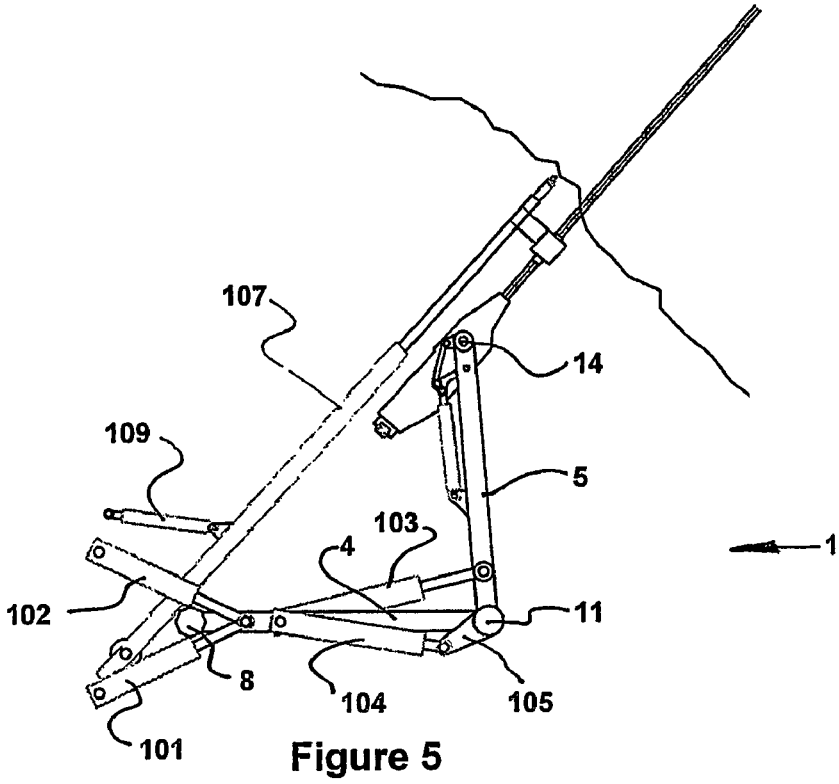
FIG. 5: is a schematic side elevation of the apparatus of FIGS. 1 to 4 in use showing the various hydraulic cylinders and pin joint linkages.

FIG. 5 shows schematically the operation and actuation points of the various hydraulic cylinders, linkages and pivot joints.

In the first preferred embodiment all hydraulic hosing associated with the various hydraulic equipment is housed within the inner and outer arms 4, 5 (not shown in FIG. 5). This is a significant advantage over prior art designs.

In order to enable hydraulic fluid, water and air to reach the various hydraulic equipment, hammer and drill 203 rotary seals and ported pins are employed in the joints and are configured and arranged to allow 360 degree rotation without twisting hoses.

In the first preferred embodiment the apparatus 1 further includes computerised controls such that the various hydraulic control and positioning cylinders are actuated according to a pattern controlled by computer software.

Computer control also allows a multitude of different drill steel lengths 202 to be used with the same sized unit 1. The desired drill steel length 202 can simply be selected from the computer's menu and the computer then recalculates the mechanical movement to suit the drill steel length 202.

In the first preferred embodiment the linear movement of the arm 3 (used while drilling or positioning) is achieved using computer control. There are a number of elements to this control strategy. Firstly, the arm 3 and joint 8, 11, 14 positions are measured with sensors 301, 302, 303 and 304. These sensors are rugged devices immune to vibration, and are used to measure rotational position and velocity.

The Cartesian coordinates of the arm 107 are calculated using the measured sensor positions.

The desired angular position of the arms 4, 5 are then calculated using the Cartesian coordinates of the arm 107. The desired angular velocities are also calculated. This is done by differentiating the desired arm 4, 5 angular positions.

The desired arm joint 8, 11 velocities and arm 4, 5 positions are used to calculate desired hydraulic cylinder velocities, which are achieved through PID controllers via pulse width modulation (PWM) amplifiers driving proportional hydraulic valves.

The process variables for the PID controllers are the arm joint 8/11/14 positions. The feedback of arm joint positions are measured with sensors 301, 302 and 303.

The linear movement of the arms 4, 5 while drilling is similar in most respects to positioning. However, the arms 4, 5 and drill cradle 15 follow an imaginary line through the drill steel guide block 108, at the same shooting angle as the arm 107 into the rock.

During drilling the arm 107 extends at half the rate of the drill steel 202.

Before the start of drilling the arm 107 leads the arms 4, 5 and the drill cradle 15. The operator adjusts the angle of the arm 107 and its extension until contact is made with the rock.

As illustrated in FIGS. 9 through 18, the drilling process begins with collaring. This is the same as the drilling process described with exception that the position of the arm 107 remains fixed during the process.

While drilling the hydraulic feed pressure is used to adjust the target velocity of the drill steel 202. Feed pressure is measured by a drilling load sensor 305 mounted between the drill 203 and the drill cradle 15.

Once the required drilling depth has been reached the drill steel 202 is automatically retracted. Retraction is essentially similar to drilling except that instead of the drill steel 202 following the line into the rock it follows the line in the opposite direction and the arm 107 remains fixed throughout the process.

A self-diagnostic feature forms part of the computer control system. In that regard, the hydraulic proportional control valves require calibration data so the computer is able to control cylinder velocities accurately. The computer moves each joint 8, 11, 14 over a range of Pulse Width Modulations (PWM) while measuring the velocity for each joint. From this the cylinder velocities are calculated. This modulation/cylinder velocity data is stored and used for positioning and drilling operations.

Because of the mechanical and electrical nature of the control systems of the first preferred embodiment, it lends itself well to data storage and display such as tool and drill steel consumption and efficiency, rock hardness and geology, and simple information like the number of bolts installed in one shift. Presently available rock bolting systems are fully mechanical and offer no means of recording rock geology or other important data.

The first preferred embodiment thus can further include a geo-detection system to record rock geology through the use of pressure sensors on the drill hammer. Desirably this information is sent to a touch screen control panel (TSCP) or the like and is then translated to a 3D image of the tunnel in which holes bored by the drill unit can be displayed. This allows project geologists to view the rock conditions in real-time. The holes may be colour-coded to indicate varying hardness of the rock.

Figure 6:
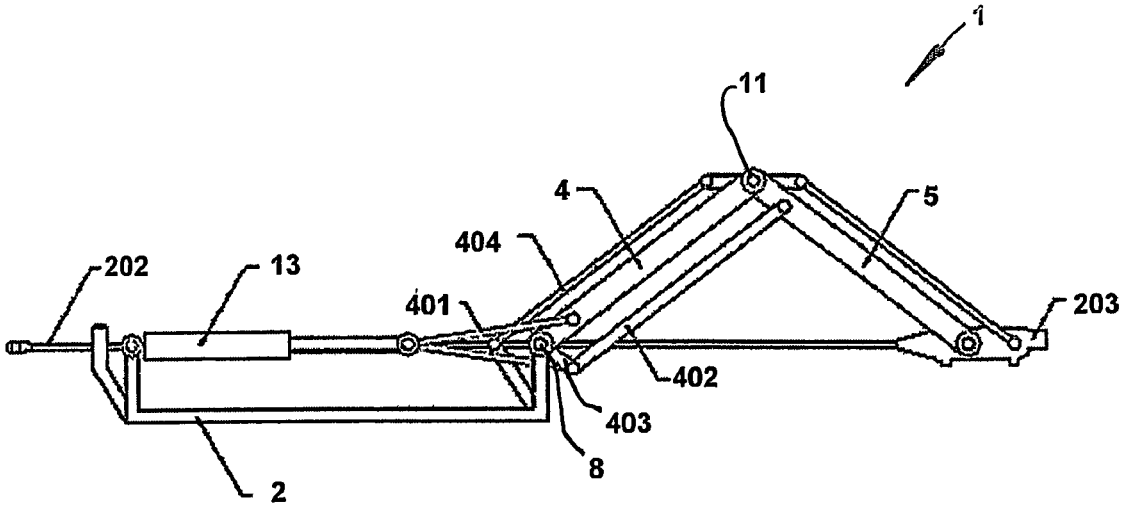
FIG. 6: is a schematic side elevation of an alternative, substantially mechanically actuated version, of a apparatus according to the invention.
Figure 7:
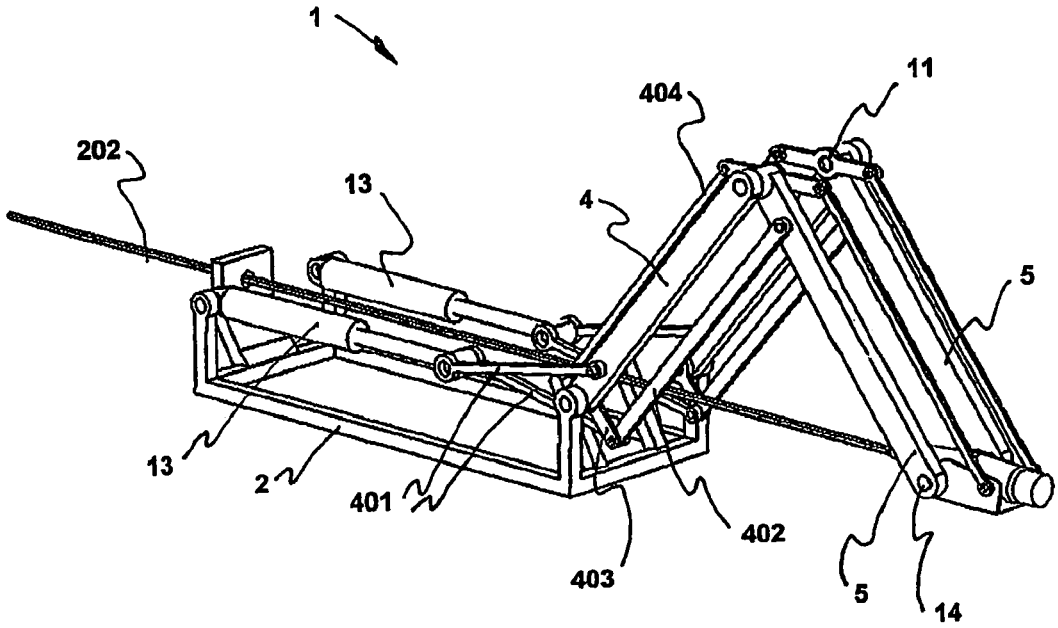
FIGS. 7 & 8: are three dimensional schematic views of the apparatus of FIG. 6 in different states of actuation.
Figure 8:
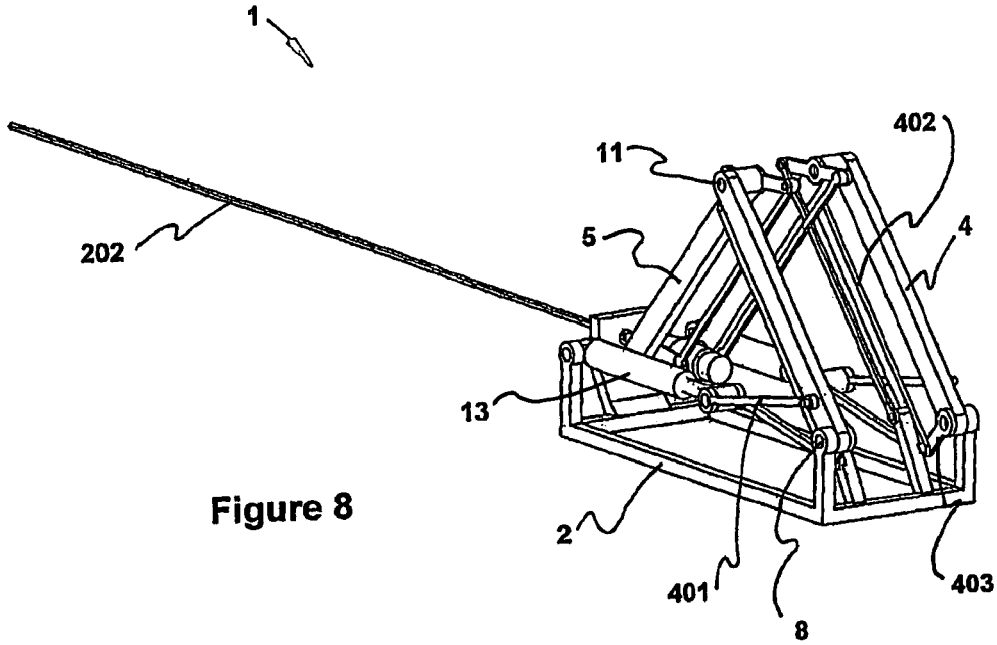
Figure 9:
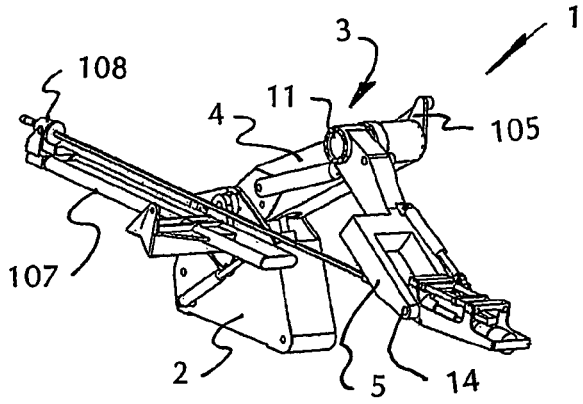
FIGS. 9 to 12: are a series of three dimensional views of the apparatus of FIGS. 1 to 4 at different stages of actuation, demonstrating the range of motion possible.
Figure 10:
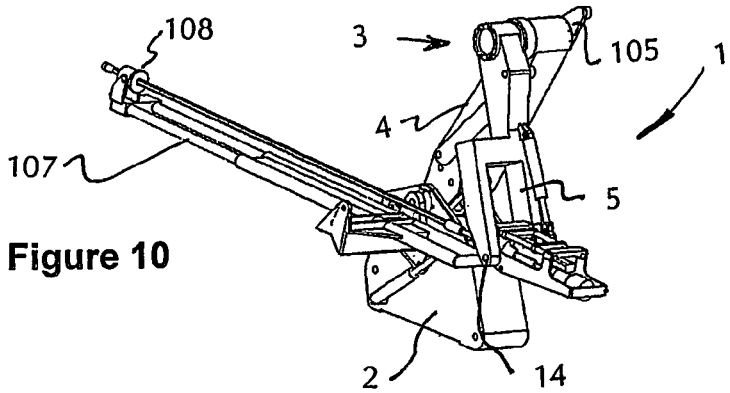
Figure 11:
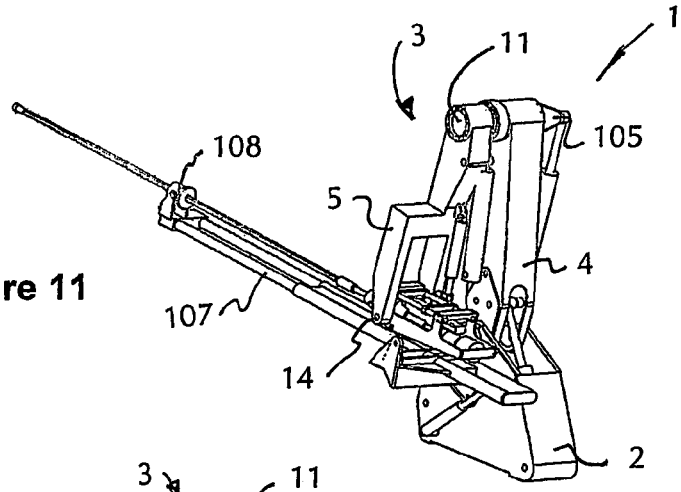
Figure 12:
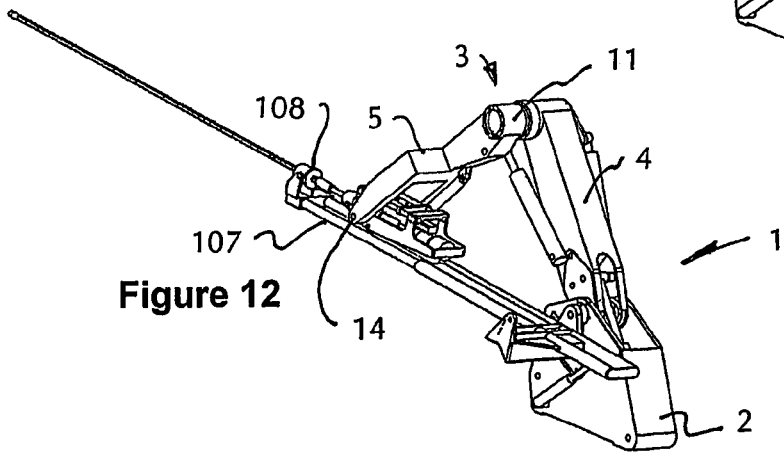
Figure 15:
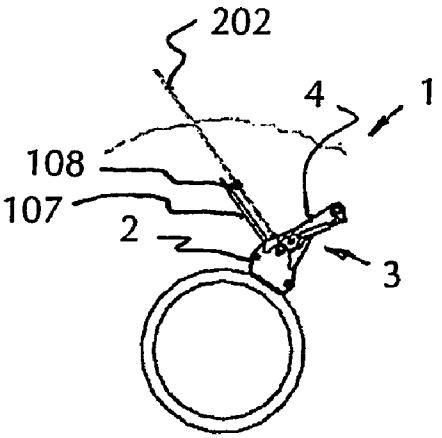
FIGS. 13 to 18: are a series of side elevations of the apparatus of FIGS. 1 to 4 at various stages of actuation during the drilling process.
Figure 18:
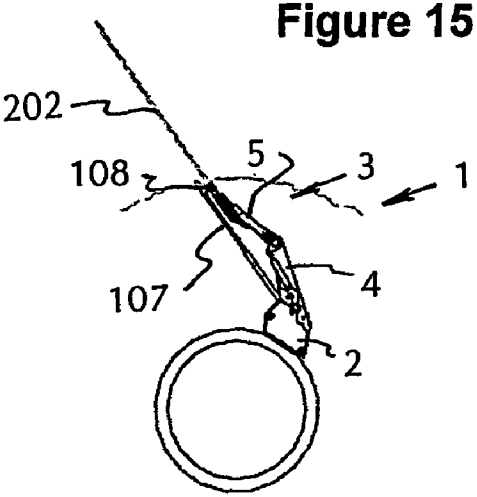
Figure 14:
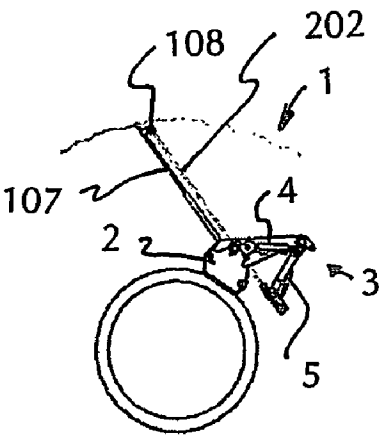
Figure 17:
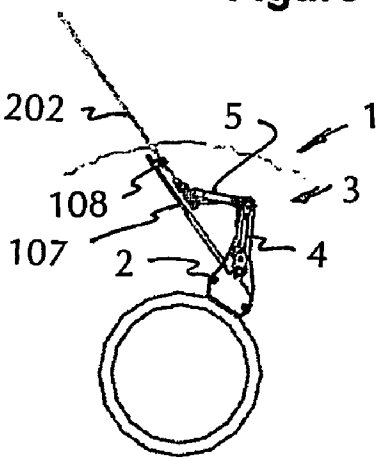
Figure 13:
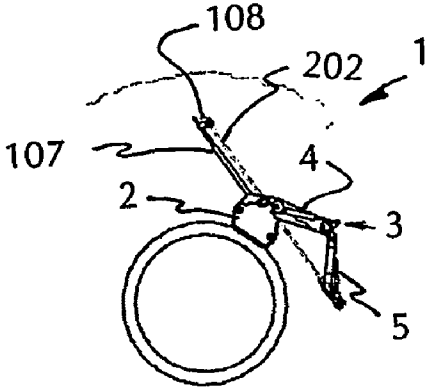
Figure 16:
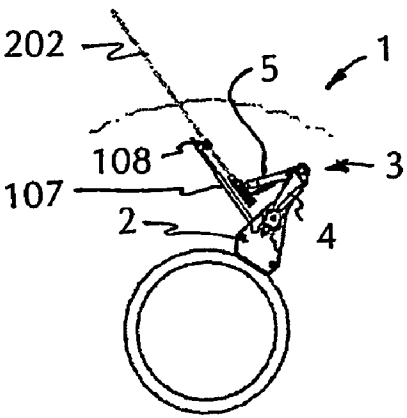

Referring now specifically to FIGS. 6 to 8, a wholly mechanical version of apparatus 1 is shown.

In this second preferred embodiment there is no computerised control. It is purely a mechanical design incorporating hydraulic cylinders and mechanical linkages. However, the operating principles are fundamentally the same as in the first preferred embodiment, and like components are like numbered.

As illustrated, there are two side by side arms 3, with the two inner arms 4 spaced apart to allow the outer arm pair 5 to swing through between them.

The cylinder linkages 401 rotate the inner arms 4 anti-clockwise when the hydraulic cylinders 13 are retracted. During the first half of the stroke, the outer arms 5 are pulled forward by reaction arms 402 (which are in tension). During the second half of the stroke, the outer arms 5 are pushed forward by the reaction arms 402 (the reaction arms are in compression), which are connected to the lever arms 403. The lever arms 403 are rotated via the cylinder linkages 401 when the cylinders 13 are retracted, thus causing the outer arms 5 to rotate in a clockwise direction.

The rock drill attitude is maintained via the two drill leveling arms 404.

While the hydraulics of the first preferred embodiment has been described as computer controlled, in an alternative approach control can be achieved by utilizing flow dividers and differing sized cylinders to maintain a linear path at the end of the arm 5. In such an embodiment the outer arm 5 connection joint 11 to the inner arm 4 travels twice the rotational distance of the inner arm joint 8 connection. To achieve this ratio a flow divider is employed so that the volume of the cylinders used to manipulate the outer arm 5 are half the volume of cylinders used for the inner arm 4.

Another method of achieving this is to use slave cylinders between the inner arm 4 and the base 2. These must be twice the volume of the cylinders used to manipulate the outer arm 5.

Turning now to use of the first preferred embodiment in the context of a bore rig arrangement, the apparatus 1 can be mounted onto the bed of a truck or the like transport unit (not shown). The component parts of the apparatus 1 are substantially as described above, however, the drill 203 is replaced with an appropriate boring head of known configuration.

Figure 19:
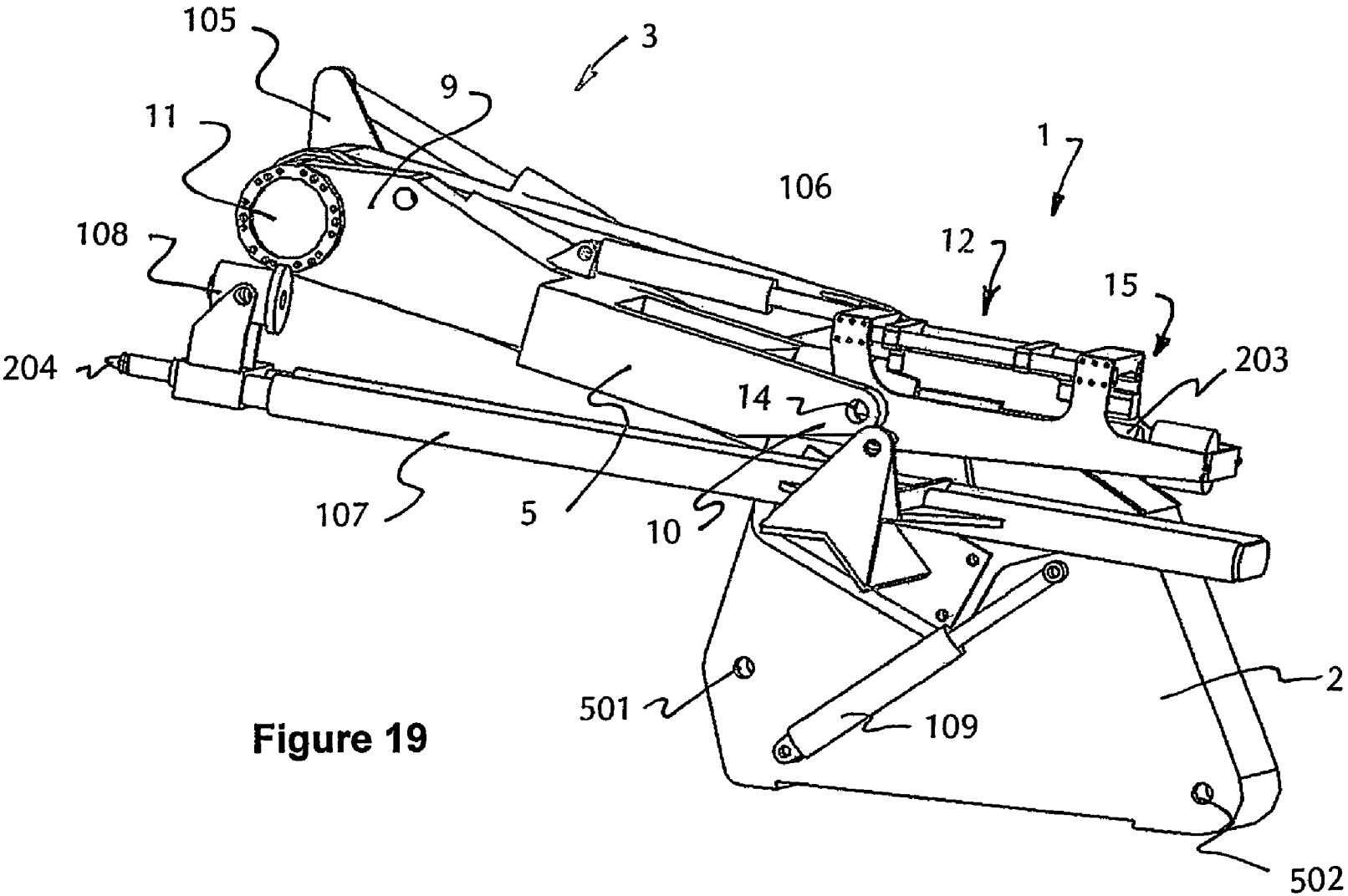
FIG. 19: is a perspective view of the apparatus of FIGS. 1 to 4 folded for purposes such as transport.
Figure 20:
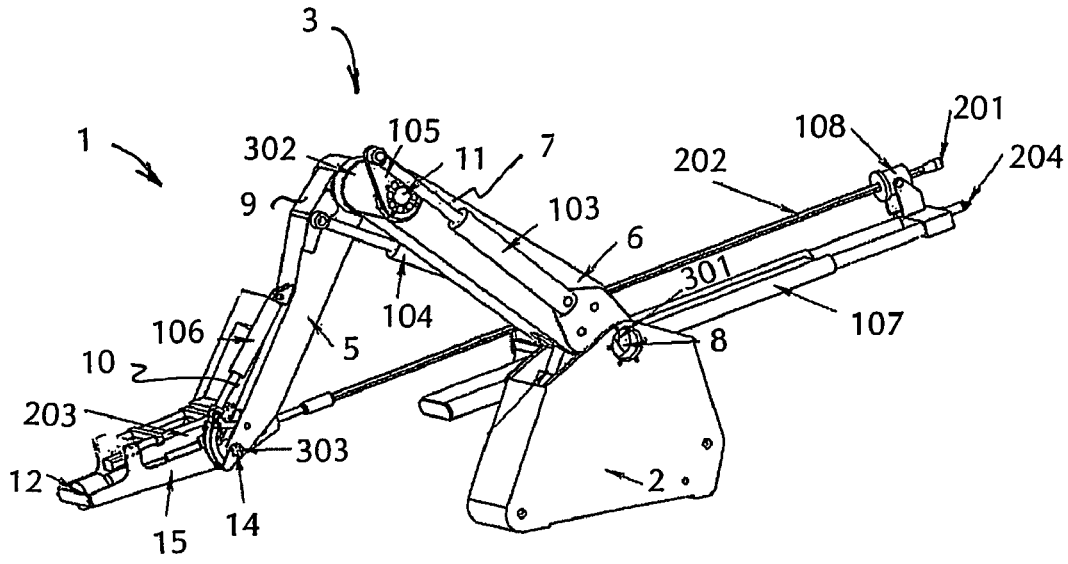
FIG. 20: is a perspective view of the apparatus of FIGS. 1 to 4 as seen from the rear right-hand side.
Figure 21:
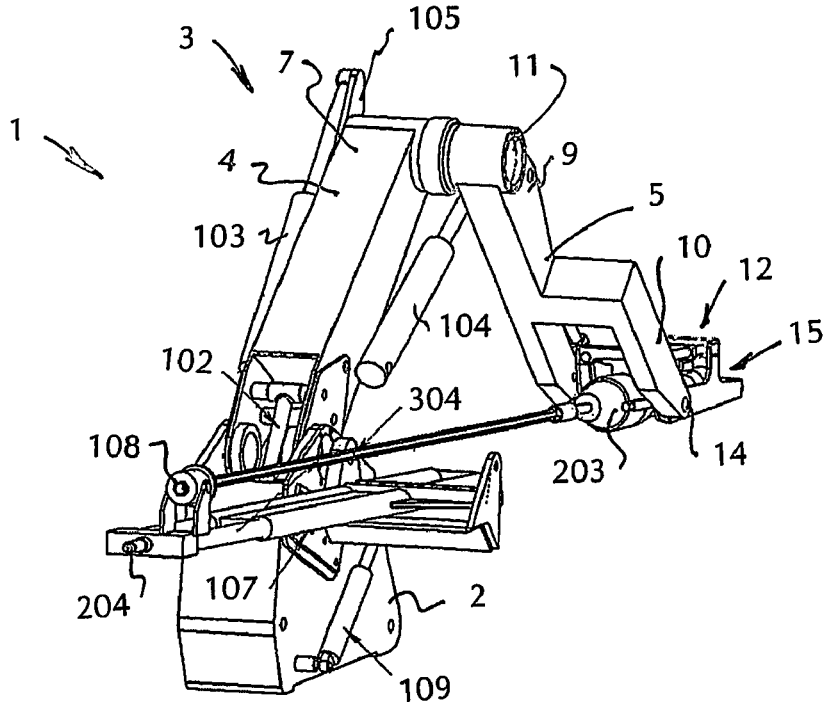
FIG. 21: is a perspective view of the apparatus of FIG. 20 as seen from the front left-hand side.

Referring specifically to FIG. 19, the base 2 can, for example, be pivotally mounted to the vehicle bed via mounts 501 and 502. In the orientation illustrated the apparatus 1 is at its most compact and ideally suited to transport. In use the base 2 may be pivoted via hydraulic cylinders at an angle of, for example, 90 degrees so that the arm 107 is directed vertically for the purposes of commencing the boring operation. Known vehicle stabilizers and the like may be employed to provide a stable boring platform.

Advantages of the present invention are thus that rock drilling apparatus utilising the technology of the invention provide a drilling arm that has few wearing parts, no exposed hydraulic hosing, and consequently much reduced maintenance, resulting in reduced costly and inconvenient down time. Further, its design configuration allows use of the apparatus in restricted spaces, unlike conventional devices.

It will be appreciated without inventive adaptation the apparatus of the present invention can be modified for spraying shot-crete as a tunnel lining. In such a set up the same basic mechanical design would be used but a shot-crete nozzle would work in conjunction with the drill to enable one rig to perform two tasks. The computerised control for movement would be modified to suit this further application.

Where in the foregoing description reference has been made to integers or components having known equivalents then such equivalents are herein incorporated as if individually set forth.

Although this invention has been described by a way of example using possible embodiments, it is to be appreciated that improvements and/or modifications may be made thereto without departing from the scope of the invention as claimed.

The invention claimed is:

1. A drilling apparatus comprising a plurality of pivotably connected components, said plurality of pivotably connected components including a base, a mounting means for a drill, and a plurality of arms coupling said base to said mounting means; said components being linked to one and other by pivot joints; said drilling apparatus further comprising drive means associated with the pivot joints operable to rotate said linked components relative to one another at a controlled rate so as to drive the mounting means along a substantially linear path.

2. The drilling apparatus as claimed in claim 1, wherein the plurality of arms comprise an inner arm and an outer arm, said inner arm having a first end and a second end, said outer arm having a pivot joint end and a free end, said first end of said inner arm being pivotally connected via a first said pivot joint to the base, and said second end of said inner arm being pivotally connected via a second said pivot joint to the pivot joint end of the outer arm.

3. An apparatus according to claim 2, wherein the inner arm is offset from the outer arm to allow the outer arm to rotate past the inner arm without interference.

4. An apparatus according to claim 3 wherein the outer arm can rotate at least 320 degrees relative to the inner arm.

5. An apparatus according to claim 2, wherein the inner arm can rotate 180 degrees relative to the base.

6. An apparatus according to claim 2, wherein the inner arm and the outer arm are substantially the same length, and the base is configured and arranged to avoid interfering with the free end of the outer arm.

7. An apparatus according to claim 2, wherein the mounting means is pivotally mounted via a third said pivot joint to the free end of the outer arm.

8. An apparatus according to claim 7, wherein the third pivot joints serves as a drill angle correction joint so as to, in use, keep a drill steel on a predetermined correct plane during the drilling process.

9. An apparatus according to claim 8, wherein the apparatus further includes a drill steel support arm engageable between the base and a face of a material being drilled to facilitate support of a drill steel in a predetermined correct position during drilling.

10. An apparatus according to claim 9 wherein the said support arm is retractable, with retraction or advancement of the support arm being parallel to the drilling axis.

11. An apparatus according to claim 1, wherein the drive means comprises hydraulic actuators operably associated with said pivot joints.

12. An apparatus according to claim 11, wherein said hydraulic actuators comprise hydraulic piston and cylinder assemblies.

13. An apparatus according to claim 1, wherein the apparatus further includes computerised controls for actuating said drive means according to a pattern controlled by computer software.

14. A drilling apparatus comprising a base, a mounting means for a drill, and a drill mounting arm pivotally coupling said base to said mounting means;

said drill mounting arm comprising an inner arm and an outer arm, said inner arm having a first end and a second end, and said outer arm having a pivot joint end and a free end; said first end of the inner arm being pivotally connected via a first pivot joint to the base, and said second end of said inner arm being pivotally connected via a second pivot joint to the pivot joint end of the outer arm; said mounting means being provided at the free end of the outer arm; the apparatus further including drive means for driving the mounting means at the free end of the outer arm along a substantially linear path, wherein the drive means comprises hydraulic actuators operably associated with said pivot joints, said hydraulic actuators comprising hydraulic piston and cylinder assemblies, wherein the second pivot joint includes an offset arm on the same axis as the outer arm but offset by 90 degrees to the outer arm, actuation of the second pivot joint being achieved via a pair of said hydraulic cylinders mounted such that when the first said hydraulic cylinder is fully extended or retracted, and therefore has no ability to rotate the outer arm, the second said hydraulic cylinder is in the middle of its stroke.

15. An apparatus according to claim 14 wherein all hydraulic hosing associated with the drive means is housed within the inner and outer arms.

16. An apparatus according to claim 15 further including a drill mounted on the mounting means.

17. An apparatus according to claim 16 wherein in order to enable hydraulic fluid, water and air to reach the various hydraulic equipment and the drill mounted on the mounting means rotary seals and ported pins are employed in the joints and are configured and arranged to allow 360 degree rotation without twisting hoses.

18. An apparatus according to claim 15 wherein the mounting means includes a shotcrete nozzle and the apparatus includes shotcrete feed pipes to enable, in use, shotcrete to be sprayed using the drilling apparatus.

19. A drilling apparatus comprising a base, a mounting means for a drill, and a drill mounting arm pivotally coupling said base to said mounting means;

said drill mounting arm comprising an inner arm and an outer arm, said inner arm having a first end and a second end, and said outer arm having a pivot joint end and a free end; said first end of the inner arm being pivotally connected via a first pivot joint to the base, and said second end of said inner arm being pivotally connected via a second pivot joint to the pivot joint end of the outer arm; said mounting means being provided at the free end of the outer arm; the apparatus further including drive means for driving the mounting means at the free end of the outer arm along a substantially linear path, wherein the drive means comprises hydraulic actuators operably associated with said pivot joints, said apparatus further including computerized controls for actuating said drive means according to a pattern controlled by computer software, said computerised controls including sensors to establish the positions of the various component parts of the apparatus and such computerised controls include self-diagnostic features so that when the inner and outer arms are in a certain physical position the sensors are checked for accuracy.

20. An apparatus according to claim 19 wherein a sensor is provided on the hydraulic fluid feed circuit to sense if the drill steel is starting to become jammed.

21. An apparatus according to claim 19 wherein the apparatus includes a sensor on return feed of the hydraulic fluid feed circuit supplying rotation to the drill steel, said sensor being adapted to sense the frequency of the hammer action for determining the optimum feed speed/pressure settings.

22. An apparatus according to claim 19 wherein the apparatus further includes electronic data storage and display means for data recorded from various sensors on the hydraulic and pneumatic feeds to establish tool and drill steel consumption and efficiency, rock hardness and geology and the number of bolts installed in a given period of use.

23. An apparatus according to claim 20 wherein the wherein the apparatus includes a sensor on return feed of the hydraulic fluid feed circuit supplying rotation to the drill steel, said sensor being adapted to sense the frequency of the hammer action for determining the optimum feed speed/pressure settings.

* * * * *